US005308723A

United States Patent [19]

Inoue et al.

[11] Patent Number: 5,308,723

[45] Date of Patent: May 3, 1994

[54] THIN METALLIC SHEET FOR SHADOW MASK

[75] Inventors: Tadashi Inoue; Hidekazu Yoshizawa; Kiyoshi Tsuru; Tomoyoshi Okita; Yoshiaki Shimizu, all of Kawasaki, Japan

[73] Assignee: NKK Corporation, Tokyo, Japan

[21] Appl. No.: 6,802

[22] Filed: Jan. 21, 1993

[30] Foreign Application Priority Data

Jan. 24, 1992 [JP] Japan ..... 4-032939
Jan. 31, 1992 [JP] Japan ..... 4-040714

[51] Int. Cl.[5] ..... G03C 5/00

[52] U.S. Cl. ..... 430/23; 430/323; 445/36

[58] Field of Search ..... 430/23, 323; 445/36

[56] References Cited

FOREIGN PATENT DOCUMENTS 0104453 4/1984 European Pat. Off. .
0222560 5/1987 European Pat. Off. .
3636815 5/1987 Fed. Rep. of Germany .
62-243782 10/1987 Japan .
2-9655 3/1990 Japan .

*Primary Examiner*—Steve Rosasco
*Attorney, Agent, or Firm*—Frishauf, Holtz, Goodman & Woodward

[57] ABSTRACT

The metallic sheet for shadow mask comprises a Fe-Ni alloy sheet having mainly of Fe and Ni; degrees of planes on a surface of the alloy sheet, the degree of {331} plane being 14% or less, the degree of {210} plane 10% or less and the degree of {211} plane 10% or less; and a ratio of degrees of planes which is {210}/[{331}+{211}] being 0.2 to 1.

Another thin metallic sheet for shadow mask comprises a Fe-Ni alloy sheet having mainly of Fe and Ni; degrees of planes on a surface of the alloy sheet, that of {111} plane being 5% or less, that of {100} plane 50 to 93%, that of {110} 24% or less, that of {311} plane 1 to 10%, that of {331} 1 to 14%, that of {210} plane 1 to 10% and that of {211} plane 1 to 10%; a ratio of degrees of planes which is [{100}+{311}+{210}]/[{110}+{111}+{331}+{211}] being 0.8 to 20.

16 Claims, 9 Drawing Sheets

ETCHING FACTOR $$Ef = \frac{2H}{(d_2 - d_1)}$$

THIN METALLIC SHEET FOR SHADOW MASK

BACKGROUND OF THE INVENTION

1. Field of the Invention

The present invention relates to a thin metallic sheet for a shadow mask having high etching performance and particularly to a shadow mask thin metallic sheet made of Fe-Ni alloy suitable for a color cathode ray tube.

2. Description of the Related Art

Recent up-grading trend of color television toward high definition TV has employed Fe-Ni Invar alloy containing 34–38 wt. % of Ni as the alloy for the shadow mask to suppress color-phase shift. INVAR alloy is a low-expansion alloy containing 36% nickel, 0.35% manganese and the balance iron with carbon. The Fe-Ni Invar alloy which contains 34–38 wt. % of Ni is hereinafter referred to as "conventional Fe-Ni alloy". Compared with low carbon steel which has long been used as a shadow mask material, the conventional Fe-Ni alloy has considerably lower thermal expansion coefficient. Accordingly, a shadow mask made of conventional Fe-Ni alloy raises no problem on color-phase shift coming from the thermal expansion of shadow mask even when an electron beam heats the shadow mask.

Common practice of making a shadow mask from a thin alloy sheet includes the following steps. The alloy sheet is photo-etched to form the passage-holes for the electron beam on the thin alloy sheet for shadow mask. The passage-hole for electron beam is hereinafter referred to as "hole". The thin alloy sheet for shadow mask perforated by etching is hereinafter referred to as "flat mask". (2) The flat mask is subjected to annealing. (3) The annealed flat mask is pressed into a curved shape of cathode ray tube. (4) The pressformed flat mask is assembled to a shadow mask which is then subjected to blackening treatment. However, the Invar alloy of conventional Fe-Ni is inferior to the shadow mask material of low carbon steel in terms of etching performance to prepare many micropores.

Conventional Fe-Ni INVAR alloy is considerably weak in corrosion resistance to etching liquid and has large crystal grain size. Compared with mild steel. The result is that light penetrating through the micropores formed by the etching process results in a blurred periphery of the pierced holes of the flat mask. Also, the brightness of light penetrated through the flat mask of conventional Fe-Ni Invar alloy is inferior to that of mild steel. Such a degraded brightness of flat mask is a serious disadvantage in the recently emphasized demand for bright screens. To cope with the problem on etching performance, the prior art 1 and the prior art 2 have been presented.

The prior art 1 is introduced in JP-B-H2-9655 (the term "JP-B-" referred to herein signifies "examined Japanese patent publication"). The patent describes that precise and uniform etching is performed by aggregating {100} plane by 35% or more onto the surface of thin Invar alloy sheet. The flat mask prepared by the method, however, still has hazy photo-irregularity and weak brightness of flat mask, which are left as quality issues.

The prior art 2 is described in JP-A-S62-2437825 (the term "JP-A-" referred to herein signifies "unexamined Japanese patent publication"). In the patent, an aggregated {100} plane onto the rolled plane of Fe-Ni Invar alloy gives the surface roughness Ra in a range of 0.2 to 07 μm and Sm at 100 μm or below, and gives the crystal grain size number of No. 8.0 or above. The etching speed is improved and also the production of blurred periphery of pierced hole is reduced. Still, the flat mask prepared by this method is weak in brightness, which is left as an issue. The finest grain size number described in the patent is No. 10.0 which corresponds to 11 μm of grain size. The grain size (B), (μm), is calculated from the grain size number (A) by the following equation.

$$(A)=16.6439-6,6439\times\log\{(B)/1.125\}$$

SUMMARY OF THE INVENTION

The object of the present invention is to provide a thin metallic sheet for shadow mask which has excellent etching performance, has the capability of high precision perforation by etching, and gives high brightness of flat mask after being perforated by etching. To achieve the object, this invention provides a thin metallic sheet for shadow mask comprising:

a Fe-Ni alloy sheet having mainly of Fe and i;

degrees of planes on a surface of said alloy sheet, the degree of {331} plane being 14% or less, the degree of {210} plane being 10% or less and the degree of {211} plane being 10 or less, each of said degrees of planes being calculated by means of dividing a relative X-ray intensity ratio of each of (331), (210) and (211) diffraction planes by a sum of relative X-ray intensity ratios of (111), (200), (220), (311), (331), (420) and (422) diffraction planes; and a ratio of degrees of planes, which is {210}/[{331}+{211}] being 0.2 to 1.

Furthermore, the present invention provides a thin metallic sheet for shadow mask comprising:

a Fe-Ni alloy sheet having mainly of Fe and Ni;

degrees of planes on a surface of said alloy sheet, the degree of {111} plane being 5% or less, the degree of {100} plane being 50 to 93%, the degree of {110} plane being 24% or less, the degree of {311} plane being 1 to 10%, the degree of {331} plane being 1 to 14%, the degree of {210} plane being 1 to 10%, the degree of {211} plane being 1 to 10%, each of said degrees of planes being calculated by means of dividing a relative X-ray intensity ratio each of (111), (100), (110), (311), (331), (220) and (211) diffraction planes by a sum of relative X-ray intensity ratios of said diffraction planes; and a ratio of degrees of planes, which is [{100}+{311}+{210}]/[{110}+{111}+{331}+{211}] being 0.8 to 20.

DESCRIPTION OF THE PREFERRED EMBODIMENT

Preferred Embodiment-1

Figure 1:
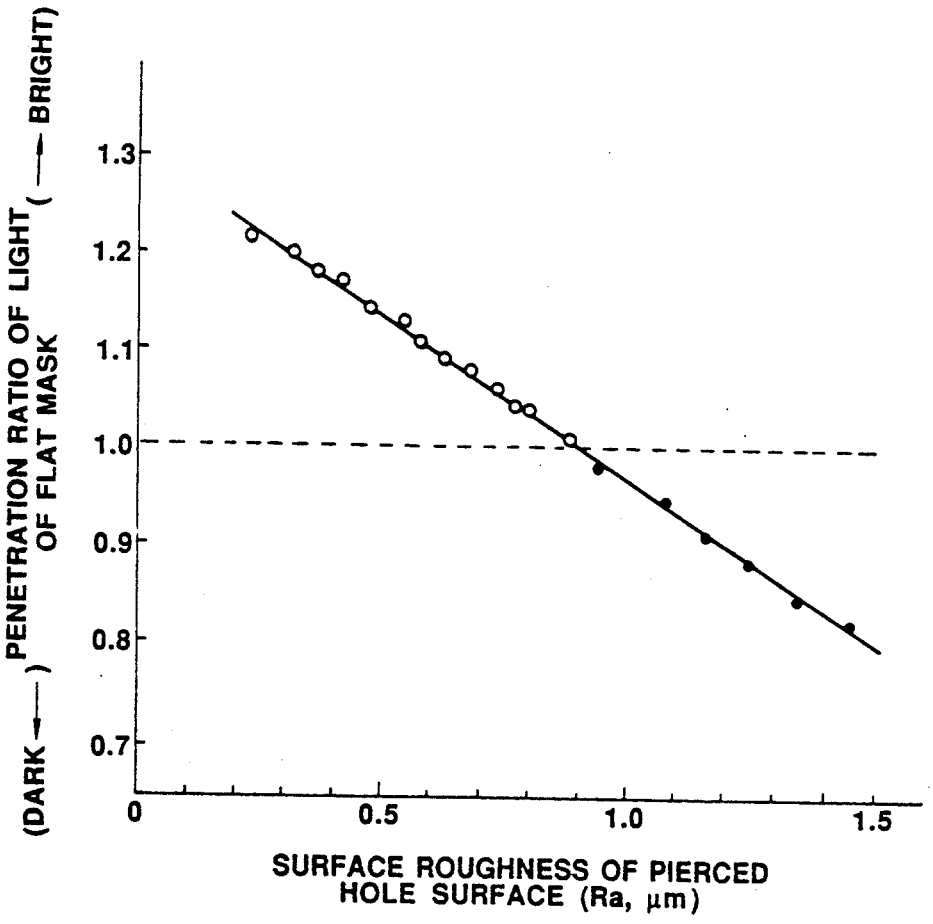
FIG. 1 shows the relation between penetration ratio of light of a flat mask and surface roughness (Ra) of pierced hole surface, being described in the preferred embodiment 1.

According to the present invention, a fine pattern is formed on a thin sheet of Fe-Ni alloy using a photo-etching process. To obtain a uniform size and shape on the whole patterning area, is necessary to keep the etching speed stable and high on the whole etching area. To do this, increase of the etching factor is important. The increase of etching factor is achieved by controlling the ratio of the degrees of specific planes on the etching plane, or the alloy sheet surface, and by controlling the crystal grain size in the thickness direction of the alloy sheet.

In addition, to increase the brightness on flat mask to a superior level after perforating by etching, an important means is to reduce the surface roughness (Ra) on pierced hole to below a specific level. The reduction of the surface roughness (Ra) to below a specific level is accomplished by controlling the degree of specified plane on the etching plane, or the alloy sheet surface. This invention focuses on both means described thereabove.

Metal Sheet for Forming the Shadow Mask

The invention is described to a greater detail in the following to begin with the reason to limit the range of degree of plane and of crystal grain size in the thin sheet of Fe-Ni alloy for shadow mask of this invention. The Fe-Ni alloy used in this invention has the effect to prevent color-phase shift. A preferred condition for the effect is to select the upper limit of average thermal expansion coefficient of the alloy at $2.0\times10^{-6}$o° C. in a temperature range of 30° to 100° C. The average thermal expansion coefficient depends on the content of Ni in the alloy. The ) content which satisfies the above limitation of average thermal expansion coefficient is in a range of 34 to 38%. When the alloy contains 0.01 to 6% of Co, the i content to satisfy the limitation is in a range of 30 to 37%.

X-ray diffraction method is applied to the Fe-Ni alloy of this invention to determine the X-ray diffraction intensity of the crystal planes of (111), (220), (311), (331), (420), and (422), and the degree of each crystal plane is determined therefrom. For example, the degree of {331} plane is determined from the relative X-ray intensity ratio of (331) diffraction plane divided by the sum of relative X-ray intensity ratios of (111), (200), (220), (311), (331), (420), and (422) diffraction planes.

The relative X-ray intensity ratio is defined as the value of X-ray diffraction intensity observed on each diffraction plane divided by the theoretical X-ray intensity of that diffraction plane. For example, the relative X-ray intensity ratio of {111} diffraction plane is the value of X-ray diffraction intensity of {111} plane divided by the theoretical X-ray diffraction intensity of {111} diffraction plane. The degree of {210} plane is determined from the relative X-ray diffraction intensity ratio of (420) diffraction plane, which plane has the same orientation with (210) plane, divided by the sum of relative X-ray diffraction intensity ratio of seven diffraction planes: (111), (200), (311), (331), (420), and (422). Similar to the above procedure, the degree of {211} plane is determined from the relative X-ray diffraction intensity ratio of (422) diffraction plane, having the same orientation with (211) plane, divided by the sum of X-ray diffraction intensity ratios of these seven diffraction planes.

The inventors controlled the degree of each of {331}, {210}, and {211} planes on the surface of the Fe-Ni alloy sheet and also controlled the ratio of degrees of these planes on the surface of the Fe-Ni alloy sheet. Those controls improved the etching factor, reduced the surface roughness (Ra) on pierced hole, and increased the brightness of the flat mask. FIG. 1 shows the relation between penetration ratio of light and surface roughness (Ra) on the pierced holes of the flat mask. In this embodiment, the alloy sheets each having different values of degrees of {331}, {210}, {211} planes on the surface of the alloy sheet were subjected to photo-etching process. The quantity of light penetrated through the obtained flat masks was measured. A flat mask was prepared from conventional mild steel being perforated by the same procedure with that applied to the alloy sheet, and the quantity of penetrated light was measured. The observed quantity of light penetrated through the alloy sheet was divided by the observed quantity of light penetrated through mild steel sheet to give the penetration ratio of light of the corresponding flat mask. FIG. 1 shows the plot of the calculated penetration ratio of light vs. surface roughness (Ra) on pierced hole. The measuring method of surface roughness followed the procedure described in Example 1. In the plot of FIG. 1, white circles (◯) correspond to the degree of 14% or less for {331} plane, 10% or less for {210} plane, and 10% or less for {211} plane, and the black circles ( ) correspond to either one of the degree of above 14% for {331} plane, above 10% for {210} plane, and above 10% for {211} plane.

As seen in FIG. 1, when the degree of the plane of {331}, {210}, and {211} is 14% or less, 10% or less, and 10% or less, respectively, the surface roughness (Ra) on pierced hole becomes 0.90 μm or less and the penetration ratio of light of flat mask becomes 1.0 or more, which enhances the brightness with a larger quantity of light penetrated than that through the conventional mild steel flat mask. The center line average roughness (Ra) most strongly contributes to the correlation between the brightness of flat mask and the surface roughness on pierced hole.

Based on the finding described thereabove, the condition to obtain a superior brightness of flat mask was selected as 14% or less for the degree of {331} plane, 10% or less for {210} plane, and 10% or less for {211} plane. When at least one condition of above 14% for the degree of {331} plane, above 10% for {210} plane, and above 10% for {211} plane is satisfied, the pierced hole surface is totally covered with irregular microstructure. Such an irregular microstructure presumably contributes to increased roughness on pierced hole exceeding 0.90 μm.

Figure 2:
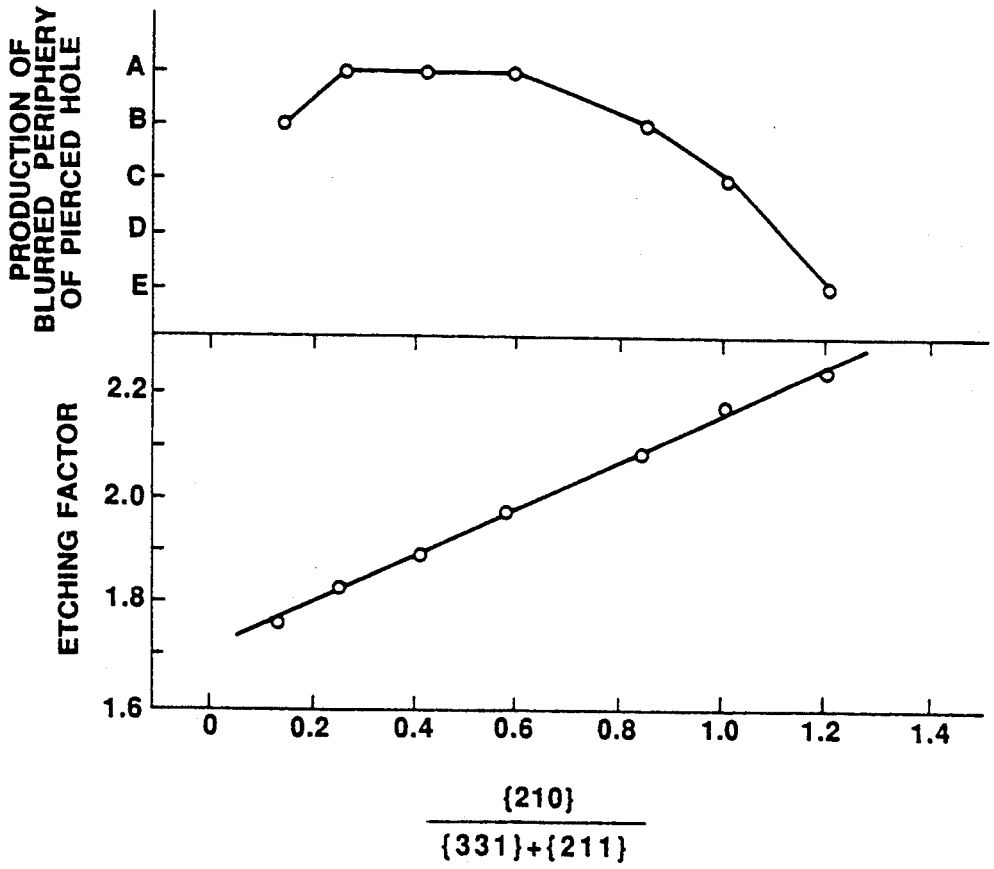
FIG. 2 shows the relation among etching factor, production of blurred periphery of pierced hole surface, and ratio of the degrees of planes, {210}/[{331}+{211}], being described in the preferred embodiment 1.

The ratio control of the degrees of planes, {331}, {210}, and {211} on the surface of the alloy sheet is necessary for the improvement of etching factor. FIG. 2 shows the relation among etching factor, production of blurred periphery of pierced hole, and ratio of the degrees of planes, {210}/[{331}+{211}]. The figure covers the range of 14% or less for the degree of {331} plane, 10% or less for {210} plane, and 10% or less for {211} plane. The measuring method of etching factor followed the procedure described in Example 1. The degree of each plane {311}, {210}, and {211} was determined by the X-ray diffraction method as described thereabove. The production of blurred periphery of pierced hole was determined by visual observation in accordance with the judgment scheme given below.

A: no production of blurred periphery of pierced hole is observed.

B: slight production of blurred periphery of pierced hole is found but completely no problem occurs in practical use.

C: production of blurred periphery of pierced hole is found to some extent but no problem occurs in practical use.

D: production of blurred periphery of pierced hole appears to raise problem in practical use.

E: marked production of blurred periphery of pierced hole appears and problem occurs in practical use. The grades A through C give no problem in practical use.

With the increase of the ratio of the degrees of planes, {210}/[{331}+{211}], the value of etching factor increased. Accordingly, this invention specifies the value of etching factor as 1.8 which raises no problem in practical use. The relation between etching factor and ratio of the degree of these planes, which is given in FIG. 2, specifies 0.2 or higher ratio of the degree of these planes to give 1.8 or higher etching factor. However, if the ratio of the degrees of these planes exceeds 1.0, then the production of blurred periphery of pierced hole is degraded to raise problem in practical use. Consequently, the ratio of the degrees of planes, {210}/[{331}+{211}], which gives favorable grade, A, B, or C, and which gives high etching factor is specified within a range of 0.2 to 1.0.

The ratio of the degrees of planes ranging from 0.2 to 0.6 is more preferable for the production of blurred periphery of pierced hole. The range of over 0.6 but less than 1 is more preferable for the etching factor. Furthermore, the range of 0.4 to 0.8 is by far more preferable for both of the production of blurred periphery and the etching factor.

Figure 3:
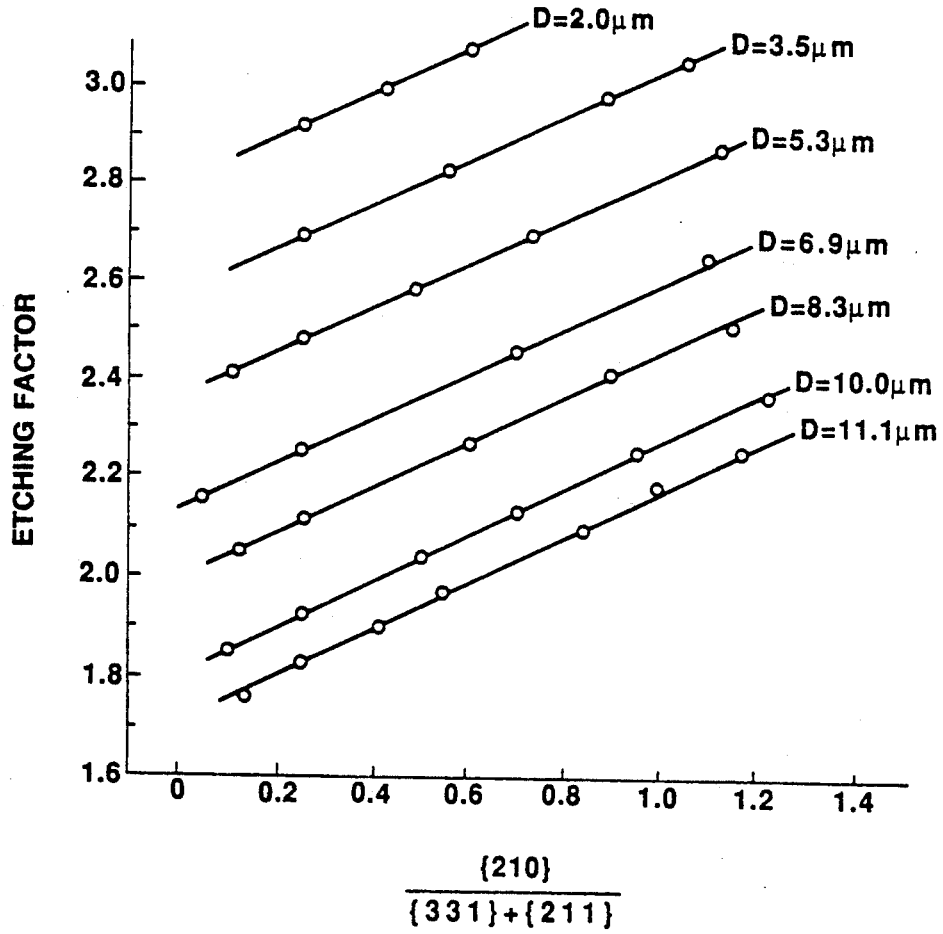
FIG. 3 shows the relation among etching factor, ratio of the degrees of planes, {210}/[{331}+{211}], and crystal grain size (D) in the thickness direction of a Fe-Ni alloy sheet, being described in the preferred embodiment 1.

According to this invention, etching factor is improved by controlling the ratio of the degrees of specific planes on the surface of an alloy sheet, as described above. More preferably, the grain size in the thickness direction of the alloy sheet is selected at 10 μm or less to obtain a higher etching factor. The grain size of 10 μm or less corresponds to the grain size number of No. 10.3 or higher level. FIG. 3 shows the relation among etching factor, ratio of the degrees of planes, {210}/[{331}+{211}], and crystal grain size (D) in the thickness direction of the alloy sheet. The figure covers the range of 14% or less for the degree of {331} plane, 10% or less for {210} plane, and 10% or less for {211} plane. As seen in FIG. 3, even at the same ratio of the degrees of planes, the etching factor is increased by decreasing the crystal grain size in the thickness direction of the alloy sheet at or below 10 μm.

Figure 4:
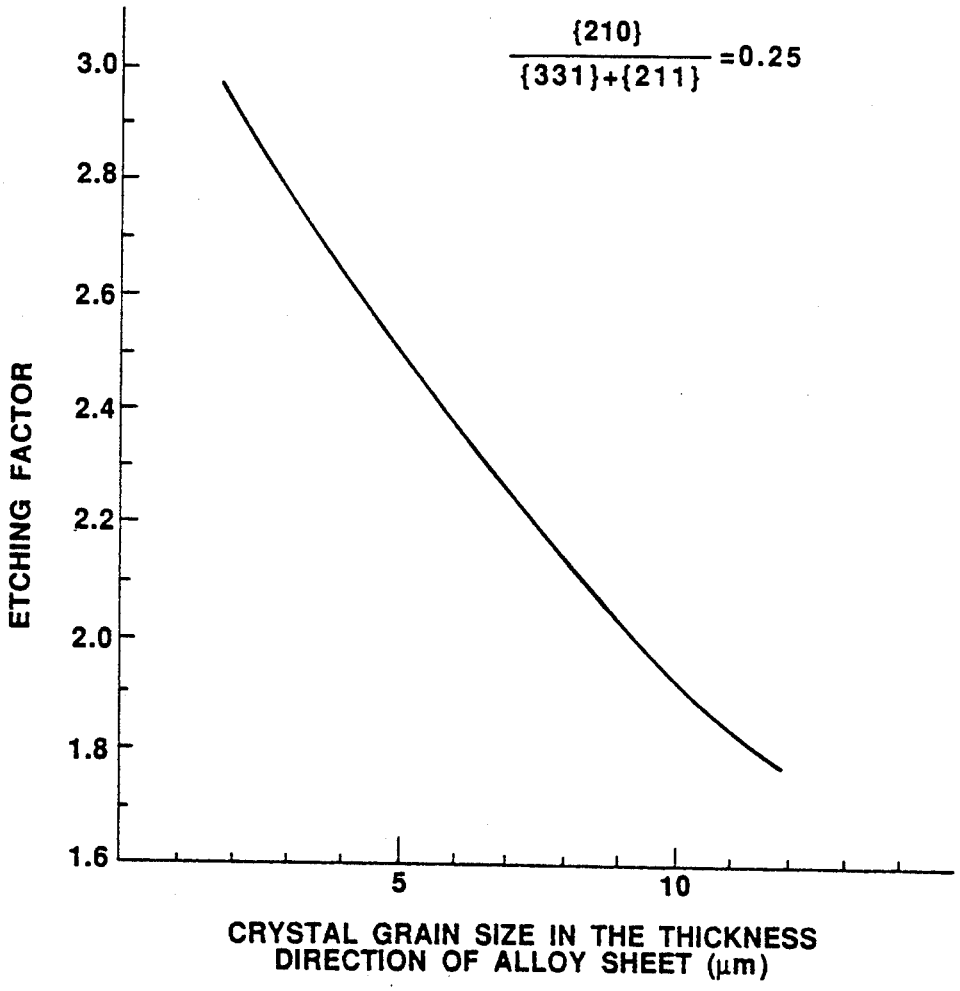
FIG. 4 shows the relation between etching factor and crystal grain size in the thickness direction of the alloy sheet, being described in the preferred embodiment 1.

FIG. 4 shows the relation between etching factor and crystal grain size in the thickness direction of the alloy sheet under the specific condition of 0.25 (fixed) for the ratio of the degrees of planes, {210}/[{311}+{211}], which is taken from FIG. 3. When the crystal grain size in the thickness direction is 10 μm or less, the etching factor is higher. When the crystal grain size is 1 to 5 μm, the etching factor is by far more preferable.

The alloy for the shadow mask of this invention specifies the degree of each plane and ratio of the degree of plane on the surface of Fe-Ni or Fe-Mi-Co alloy sheet. For the case of Fe-Ni alloy, 34–38% of i content is preferred. More preferable is the nickel content of 35 to 37%. The most preferable is the nickel range of 35.5 to 36.5%. In the case of Fe-Ni-Co alloy, 30–37% of i content and 0.01–6% of Co content are preferable. Other than those ingredients, 0.005% or less of C, 0.35% of less of Mn, 0.05% or less of Si, 0.05% or less of Cr, 0.0015% or less of N, and 0.0020% or less of O are the most preferable contents.

To keep the degree of each plane, {331}, {210}, and {211}, on the surface of Fe-Ni alloy sheet at or below the level specified in this invention, it is preferred to select adequate conditions of thin alloy sheet making. All through the treatment from solidification, hot roll, cold rolling, to annealing, the conditions are selected, to the extent possible, to prevent the formation of these planes. For example, when the alloy is prepared from a hot-rolled steel strip which was obtained by blooming and hot-rolling the ingot or continuous casting slab, an effective means to suppress the formation of planes, {331}, {210}, and {211}, is to give an adequate annealing after the hot-rolling. Temperature of annealing of hot-rolled sheet is preferably selected in a range of 910° to 990° C.

To obtain the ratio of the degrees of planes, {331}, {210}, and {211} within the range specified in this invention, the cold-rolling, annealing, and finish cold-rolling are carried responding to the degree of each plane of {331}, {210}, and {211} after annealing the hot-rolled sheet. The reduction ratio of cold-rolling, condition of annealing and finish cold-rolling are optimized. The annealing condition includes temperature, time, and heat-up rate.

The effect of annealing of hot-rolled sheet appears when the hot-rolled alloy strip is sufficiently crystallized before annealing. To acquire the satisfactory degrees of these three planes being focused on in this invention, a uniform heat treatment of the slab after slabbing is not preferable. For example, when a uniform heat treatment is carried at 1200° C. or higher temperature for 10 hours or longer period, the degrees of these three planes exceeds the range specified in this invention. Therefore, such a uniform heat treatment must be avoided.

EXAMPLE-1

A series of ladle refining produced alloy ingots having the composition listed in Table 1. In Table 1, H is represented by ppm and compositions other than H are by wt. %. These ingots were subjected to slabbing, surface scarfing, and hot-rolling to provide hot-rolled steel strips. The heating condition in hot-rolling was 1100° C. for 3 hours. The hot-rolled steel strips were annealed in a temperature range of 910° to 990° C. A&ter annealing, the hot-rolled steel strips were subjected to cold-rolling, annealing, and finish cold-rolling. By varying the conditions of cold-rolling, annealing after the cold-rolling, and finish cold-rolling, the materials No. 1 through No. 21 were obtained. Each of these materials had a specific degree of plane and crystal grain size in the thickness direction of the alloy sheet, which are shown in Table 2. The degree of each of planes, {331}, {210}, and {210} was determined by X-ray diffraction method described above.

Figure 5:
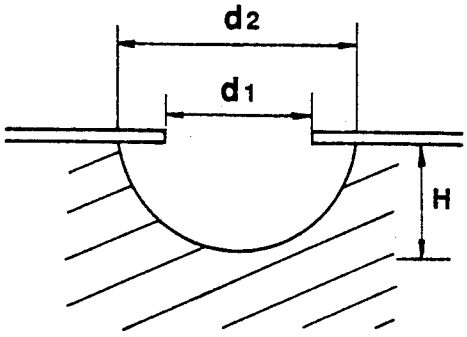
FIG. 5 illustrates the measuring method of etching factor.

On each of the obtained alloy sheet, a resist pattern was formed, and the etching factor was measured at 135 μm of d1 shown in FIG. 5. The method of etching factor determination is illustrated in FIG. 5, where a sample alloy sheet was preliminarily etched with aqueous ferric chloride solution of 45 Baume degree at 40° C. under 2.5 kg/cm$^2$ of spraying pressure for 50 sec of spraying. The etching factor is represented by the equation of $Ef=2Ho(d_2-d_1)$. Each of the alloy sheets was processed by photo-etching to form a flat mask, and the quantity of light penetrated therethrough was then measured. In the same manner, a conventional mild steel flat mask perforated to give the same opening with the alloy sheet was measured for its quantity of light penetrated therethrough. The penetration ratio of light of the alloy flat mask was determined from the quantity of light penetrated through the alloy sheet divided by the quantity of light penetrated through the mile steel sheet.

A non-contact laser roughness gauge was employed to determine the surface roughness on pierced hole of these flat masks. The cut-off value was 0.02 mm, and the roughness curve was derived by eliminating the tapered area on the pierced hole surface as an waving component. The center line average roughness (Ra) was determined from the roughness curve. The production of blurred periphery of pierced hole of each flat mask was determined by visual observation following the scheme used in drawing FIG. 2.

TABLE 1

| Alloy symbol | A | B | C |
|---|---|---|---|
| Ni | 35.9 | 35.7 | 36.4 |
| H (ppm) | 0.8 | 0.4 | 1.0 |
| Mn | 0.34 | 0.25 | 0.05 |
| Al | 0.020 | 0.005 | 0.010 |
| Si | 0.01 | 0.002 | 0.05 |
| Cr | 0.04 | 0.01 | 0.02 |
| Ti | 0.01 | <0.01 | 0.02 |
| O | 0.0013 | 0.0009 | 0.0025 |
| N | 0.0011 | 0.0007 | 0.0015 |
| B | 0.00005 | 0.001 | 0.001 |
| P | 0.002 | 0.001 | 0.004 |
| S | 0.0010 | 0.0003 | 0.0018 |
| Mo | 0.03 | <0.01 | 0.02 |
| W | 0.02 | <0.01 | 0.01 |
| Nb | 0.02 | <0.01 | 0.01 |
| V | 0.02 | <0.01 | 0.01 |
| Cu | 0.02 | <0.01 | 0.01 |
| C | 0.0025 | 0.0014 | 0.0047 |

TABLE 2(A)

| Alloy | Material | Degrees of planes {331} | {210} | {211} | Ratio of degrees of plane* | Crystal grain size in the thickness direction (μm) |
|---|---|---|---|---|---|---|
| C | 1 | 18 | 10 | 7 | 0.40 | 13.2 |
| B | 2 | 13 | 13 | 5 | 0.72 | 11.2 |
| B | 3 | 12 | 7 | 12 | 0.29 | 8.8 |
| A | 4 | 2 | 7 | 4 | 1.17 | 11.1 |
| A | 5 | 14 | 3 | 9 | 0.13 | 11.1 |
| B | 6 | 13 | 4 | 3 | 0.25 | 11.1 |
| B | 7 | 7 | 6 | 4 | 0.55 | 11.1 |
| B | 8 | 1 | 5 | 4 | 1.00 | 11.1 |
| C | 9 | 8 | 3 | 4 | 0.25 | 10.0 |
| C | 10 | 12 | 5 | 7 | 0.26 | 8.3 |
| C | 11 | 8 | 4 | 8 | 0.25 | 6.9 |
| C | 12 | 3 | 2 | 5 | 0.25 | 5.3 |
| C | 13 | 8 | 3 | 4 | 0.25 | 3.5 |
| C | 14 | 2 | 1 | 2 | 0.25 | 2.0 |
| B | 15 | 9 | 10 | 9 | 0.56 | 8.8 |
| A | 16 | 11 | 10 | 9 | 0.50 | 8.9 |
| A | 17 | 3 | 2 | 1 | 0.50 | 7.7 |
| A | 18 | 0 | 2 | 3 | 0.57 | 3.3 |
| B | 19 | 1 | 1 | 1 | 0.50 | 5.5 |
| A | 20 | 1 | 1 | 1 | 0.50 | 7.7 |
| C | 21 | 5 | 5 | 4 | 0.50 | 7.0 |

Remarks *Ratio of degrees of planes is {210}/[{331} + {221}]

TABLE 2(B)

| Alloy | Material | Surface roughness (μm) | Penetration Ratio of light | Production of blurred periphery of pierced hole on flat mask | Etching factor |
|---|---|---|---|---|---|
| C | 1 | 1.08 | 0.95 | B | 1.81 |
| B | 2 | 0.93 | 0.98 | B | 2.01 |
| B | 3 | 1.16 | 0.91 | A | 2.09 |
| A | 4 | 0.87 | 1.01 | E | 2.24 |
| A | 5 | 0.79 | 1.04 | B | 1.76 |
| B | 6 | 0.76 | 1.05 | A | 1.82 |
| B | 7 | 0.61 | 1.09 | A | 1.96 |
| B | 8 | 0.67 | 1.08 | C | 2.17 |
| C | 9 | 0.72 | 1.06 | A | 1.92 |
| C | 10 | 0.53 | 1.13 | A | 2.11 |
| C | 11 | 0.40 | 1.17 | A | 2.25 |
| C | 12 | 0.39 | 1.16 | A | 2.48 |
| C | 13 | 0.30 | 1.20 | A | 2.69 |
| C | 14 | 0.21 | 1.22 | A | 2.92 |
| B | 15 | 0.56 | 1.10 | A | 2.23 |
| A | 16 | 0.56 | 1.11 | A | 2.20 |
| A | 17 | 0.54 | 1.12 | A | 2.30 |
| A | 18 | 0.35 | 1.18 | B | 2.91 |
| B | 19 | 0.46 | 1.14 | A | 2.63 |
| A | 20 | 0.52 | 1.12 | A | 2.31 |
| C | 21 | 0.43 | 1.15 | A | 2.40 |

Materials of No. 6 through No. 21 in Table 2 have the degree of each of planes, {311}, {210}, and {211}, and the ratio of the degrees of planes, {210}/[{331}+{211}], within the range specified in this invention. Materials of No. 6 through No. 21 have 0.90 μm or less of surface roughness (Ra) on pierced hole and have 1.0 or higher light penetration ratio of flat mask. Materials of No. 6 through No. 21 give larger quantity of light penetrated through flat mask than that through the conventional mild steel sheet flat mask. These materials have 1.8 or higher etching factor and have an production of blurred periphery of pierced hole of flat mask raising no problem in practical use.

Materials of No. 6 and No. 9 through No. 14 give the ratio of the degrees of planes, {210}/[{331}+{211}], in a range of 0.25 to 0.26. For the materials of No. 6 and No. 9 through No. 14, the crystal grain size in the thickness direction of the alloy sheet for these materials is 10 μm or less, which value is smaller than the level of conventional products, and the etching factor is higher than the conventional level, which indicates that these materials have superior etching performance. Among the materials of No. 9 through No. 14, the one giving smaller crystal grain size in the thickness direction of the alloy sheet results in higher etching factor. The fact means that the reduction of crystal grain size in the thickness direction of the alloy sheet is an important factor to increase the etching factor.

Contrary to the preferred embodiment above described, the material No. 1 does not satisfy the range specified in this invention at its {331} plane, the material No. 2 does not satisfy at its {210} plane, and the material No. 3 does not satisfy at its {211} plane. The materials of No. 1 through No. 3 exceed 0.90 μm of surface roughness (Ra) on pierced hole, and give below 1.0 of penetration ratio of light of flat mask, the latter characteristic is lower than that given in the preferred embodiment of this invention. The material No. 4 exceeds the upper limit of this invention in its ratio of the degrees of planes, {210}/[{331}+{211}], and is inferior in the production of blurred periphery of pierced hole on flat mask to the preferred embodiment of this invention. The material No. 5 gives the ratio of the degrees of planes, {210}/[{331}+{211}], below the lower limit of this invention, and gives less than 1.80 of etching factor which is below the range being focused on in this invention.

The findings hereinbefore described introduce the following advantages of this invention.

(a) By limiting the degree of each of planes, {311}, {210}, and {211}, within the range specified in this invention, the surface roughness (Ra) on pierced hole is controlled and the penetration ratio of light of flat mask is improved to an excellent level.

(b) By adjusting the ratio of the degrees of planes, {210}/[{331}+{211}], within the range specified in this invention, both etching factor and production of blurred periphery of pierced hole are improved to a superior level.

(c) By further reducing the crystal grain size in the thickness direction of the alloy sheet within the range specified in this invention, the etching factor is further increased. In other words, this invention provides a Fe-Ni thin sheet for shadow mask having an excellent etching performance.

Preferred embodiment-2

The reason to limit the range of degree of plane and of crystal grain size in the thin sheet of Fe-Ni alloy for shadow mask of the present invention is given below. The Fe-Ni alloy used in this invention has the effect to prevent color-phase shift. A preferred condition for the effect is to select the upper limit of average thermal expansion coefficient of the alloy at $2.0\times10^{-6}$/° C. in a temperature range of 300° to 100° C. The average thermal expansion coefficient depends on the content of Ni in the alloy. The Ni content which satisfies the above limitation of average thermal expansion coefficient is in a range of 34 to 38%. More preferable Ni content to reduce the average thermal expansion coefficient is in a range of 35 to 37%, and most preferably in a range of 35.5 to 36.5%. When the alloy contains 0.01 to 6% of Co, the i content to satisfy the limitation is in a range of 30 to 37%.

The X-ray diffraction method is employed on the Fe-Ni alloy of this invention to determine the X-ray diffraction intensity on the planes of (111), (200), (220), (311), (331), (420), and (422), and the degree of each crystal orientation is determined therefrom. For example, the degree of {111} plane is determined from the relative X-ray intensity ratio of (111) diffraction plane divided by the sum of relative X-ray intensity ratios of (111), (200), (220), (311), (331), (420), and (422) diffraction planes. Degrees of other planes, {100}, {110}, {311}, {331}, {210}, and {211} are also determined in the same procedure.

The relative X-ray intensity ratio is defined as the value of X-ray diffraction intensity observed on each diffraction plane divided by the theoretical X-ray intensity of that diffraction plane. For example, the relative X-ray intensity ratio of (111) diffraction plane is the value of X-ray diffraction intensity of (111) plane divided by the theoretical X-ray diffraction intensity of (111) diffraction plane. The degree of {210} plane is determined from the relative X-ray diffraction intensity ratio of (420) diffraction plane, which plane has the same orientation with {210} crystal face, divided by the sum of relative X-ray diffraction intensity ratio of seven diffraction planes: (111), (200), (220), (311), (331), (420), and (422). Similar to the above procedure, the degree of {211} plane is determined from the relative X-ray diffraction intensity ratio of (422) diffraction plane, having the same orientation with {211} plane, divided by the sum of X-ray diffraction intensity ratio of these seven diffraction planes.

Furthermore, the inventors found the fact that the Fe-Ni alloy thin sheet suppresses the curving of flat mask after etching and gives minimum production of blurred periphery of pierced hole by controlling the degree of each of crystal planes of {111}, {100}, {110}, and {311} on the surface of the alloy thin sheet. In concrete terms, the degree of {100} plane is an effective one to suppress the curving of flat mask after etching. The curving of flatmask after etching is suppressed when the degree of {100} plane becomes 50% or higher level. However, if the degree of {100} plane exceeds 93%, then the irregular etching appears. Consequently, this invention specifies the range of degree of {100} plane as 50% or more and 93% or less.

On the other hand, the degree of each of planes of {111}, {110}, and {311} enhances the curving of flat mask of after etching. The occurrence of curving of flat mask becomes serious when the degree of plane exceeds 5% for {111}, or exceeds 24% for {110}, or exceeds 10% for {311}, which raises quality problems of flat mask. Below 1% of degree of each plane, {111}, {110}, and {311}, can not increase the etching factor to a superior level, which is described later. Consequently, this invention specifies the degree of {111} plane at 5% or less, the degree of {110} plane at 24% or less, and the degree of {311} plane in a range of 1 to 10%.

Figure 6:
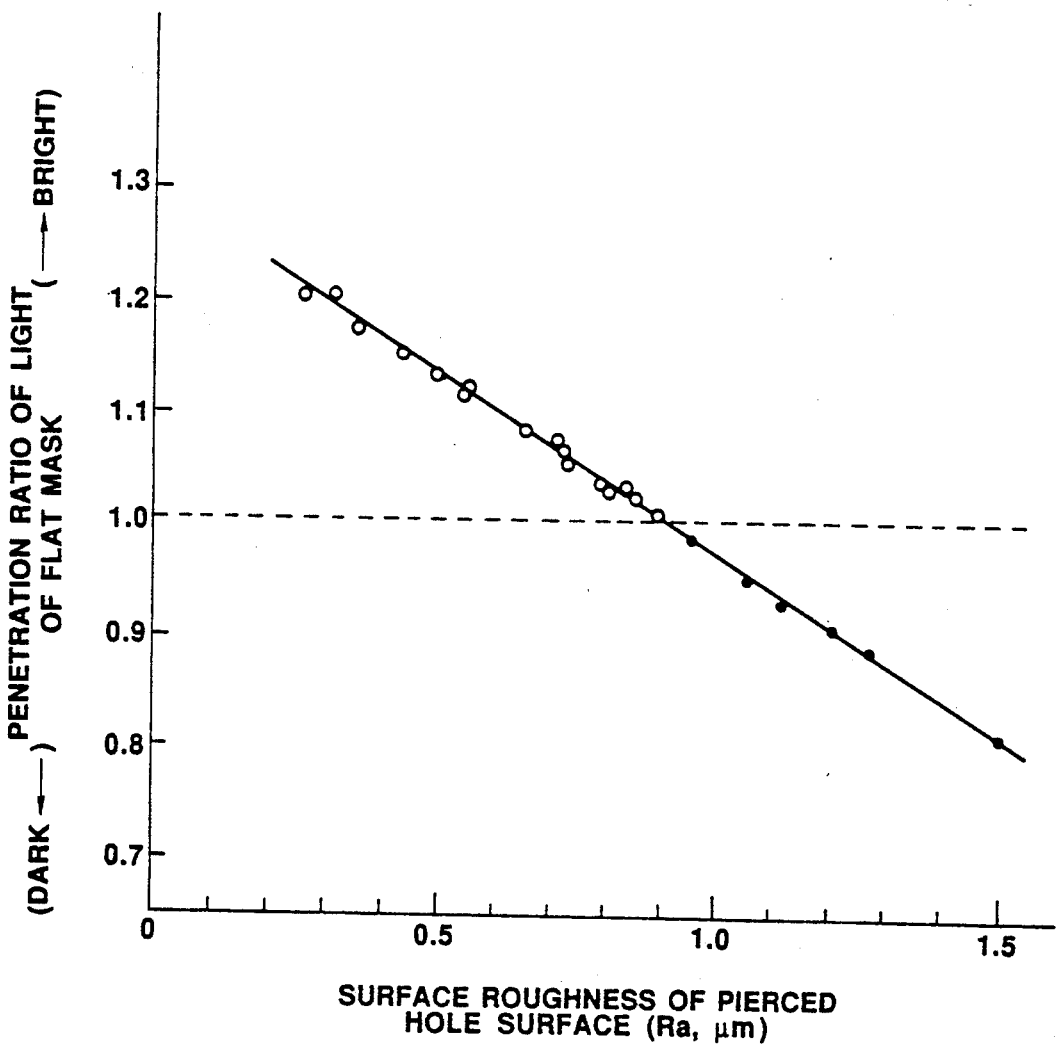
FIG. 6 shows the relation between penetration ratio of light of a flat mask and surface roughness (Ra) of pierced hole surface, being described in the preferred embodiment 2.

The inventors controlled the degree of each of {311}, {210} , and {211} planes on the surface of the Fe-Ni alloy sheet and also controlled the ratio of degrees of these planes on the surface of the alloy sheet. Those controls improved the etching factor, reduced the surface roughness (Ra) on pierced hole, and increased the brightness of flat mask. FIG. 6 shows the relation between penetration ratio of light and surface roughness (Ra) on pierced hole of a flat mask. In this embodiment, the alloy sheets having different values of degrees of {331}, {210}, {211} planes on the surface of the alloy sheet were subjected to photo-etching process, while the planes {111}, {110}, {311}, and {100} were kept within the range specified in this invention. The quantity of light penetrated through the obtained flat masks was measured. A flat mask was prepared from conventional mild steel being perforated by the same procedure with that applied to the alloy sheet, and the quantity of penetrated light was measured. The observed quantity of light penetrated through the alloy sheet was divided by the observed quantity of light penetrated through mild steel sheet to give the penetration ratio of light of the corresponding Invar flat mask. FIG. 6 shows the plot of the calculated penetration ratio of light vs. surface roughness (Ra) on pierced hole. In FIG. 6, white circles (○) correspond to the following conditions:

degree of {111} plane: 5% or less,
degree of {100} plane: 50 to 93%,
degree of {110} plane: 24% or less,
degree of {311} plane: 1 to 10%,
degree of {331} plane: 1 to 14%,
degree of {210} plane: 1 to 10%,
degree of {211} plane: 1 to 10%.

The black circles correspond to the following conditions:

degree of {331} plane: above 14%,
degree of {210} plane: above 10%,
degree of {211} plane: above 10%.

As seen in FIG. 6, when the degree of each plane of {331}, {210}, and {211} is 14% or less, 10% or less, and 10% or less, respectively, the surface roughness (Ra) on pierced hole becomes 0.90 μm or less and the light penetration ratio of flat mask becomes 1.0 or above, which enhances the brightness with a larger quantity of light penetrated than that through the conventional mild steel flat mask. The center line average roughness (Ra) most strongly contributes to the correlation between the brightness of flat mask and the surface roughness on pierced hole.

According to the present invention, when the degree of each of planes {111}, {100}, and {110} is controlled to individually specified value, and if the degree of each of {331}, {210}, and {211} planes is less than 1%, then the etching factor, which is described later, can not be increased to a superior level. Consequently, this invention specifies the degree of {331} plane in a range of 1 to 14%, degree of {210} plane in a range of 1 to 10%, and degree of {211} plane in a range of 1 to 10% to increase the brightness and etching factor to a superior level.

When at least one condition of above 14% for the degree of {331} plane, above 10% for {210} plane, and above 10% for {211} plane is satisfied, the pierce hole surface is totally covered with irregular microstructure. Such an irregular microstructure presumably contributes to the roughness on pierced hole exceeding 0.90 μm.

Figure 7:
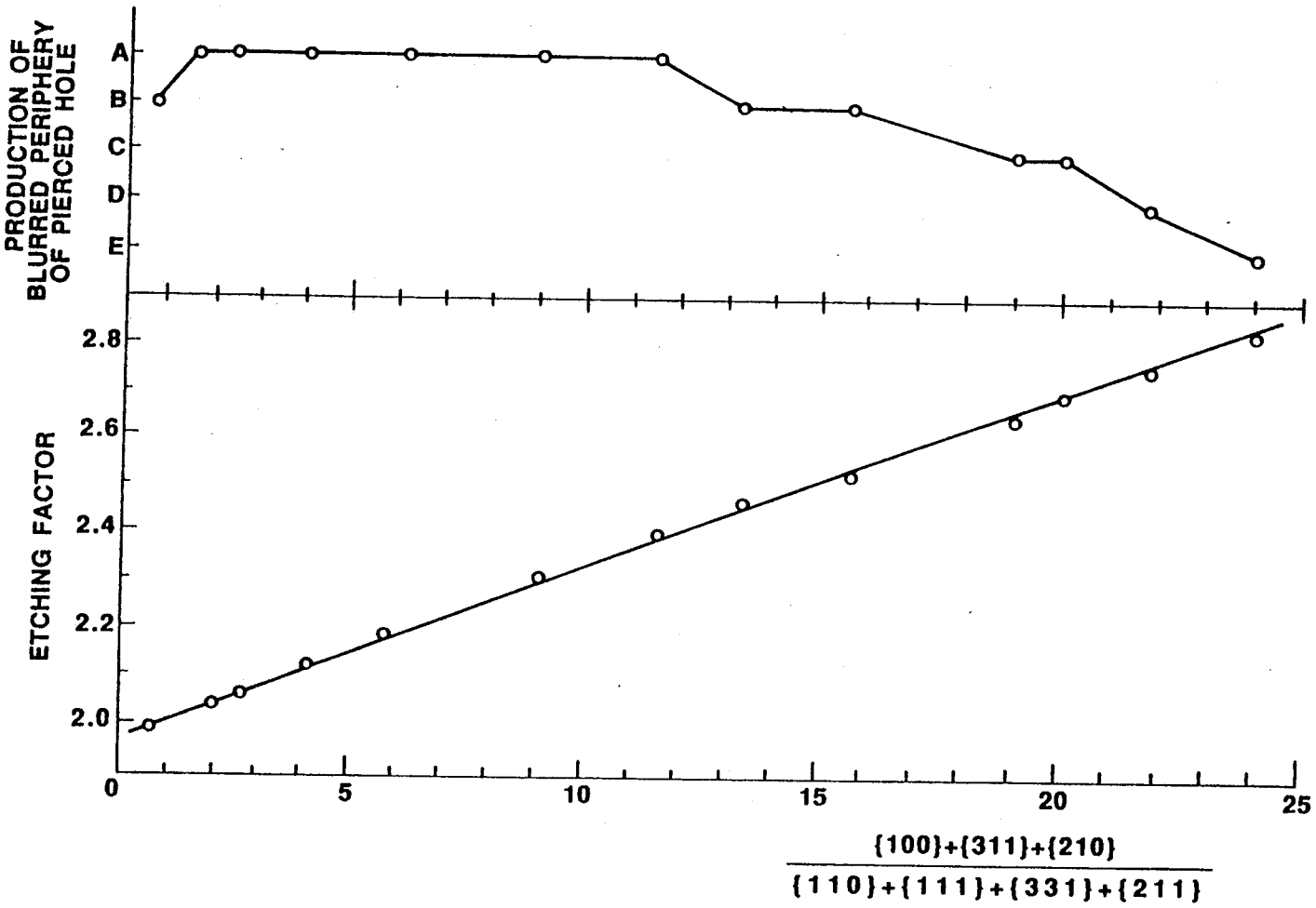
FIG. 7 shows the relation among etching factor, production of blurred periphery of pierced hole, and a ratio of the degrees of planes, [{100}+{311}+{210}]/[{110}+{111}+{331}+{211}], being described in the preferred embodiment 2.

The ratio control of the degrees of planes of major seven crystal planes on the surface of the alloy sheet is necessary for the improvement of etching factor. FIG. 7 shows the relation among etching factor, production of blurred periphery of pierced hole, and ratio of the degrees of planes, [{100}+{311}+{210}]/[{110}+{111}+{331}+{211}]. The figure covers the range of 5% or less for the degree of {111} plane, 50–93% for {110} plane, 24% or less for {110} plane, 1 to 10% for {311} plane, 1 to 14% for {331} plane, 1 to 10% for {210} plane, and 1 to 10% for {211} plane. The degree of each of major seven planes was determined by X-ray diffraction method as described thereabove. The production of blurred periphery of pierced hole was determined by visual observation in accordance with the judgement scheme given before.

As seen in FIG. 7, with the increase of ratio of the degrees of planes, [{100}+{311}+{210}]/[{110}+{111}+{331}+{211}], the value of etching factor increases. Accordingly, this invention specifies the value of etching factor at 2.0 which raises no problem in practical use. The relation between etching factor and ratio of the degrees of these planes, which is given in FIG. 2, specifies 0.8 or higher ratio of the degrees of these planes to give 2.0 or higher etching factor. However, if the ratio of the degrees of these planes exceeds 20, then the production of blurred periphery of pierced hole is degraded to raise problem in practical use. Consequently, the ratio of the degrees of the above described planes which gives favorable grade on production of blurred periphery of pierced hole, A, B, or C, and which gives high etching factor is specified within a range of 0.8–20.

The ratio of the degrees of planes ranging from 0.8 to 12 is more preferable for the production of blurred periphery of pierced hole. The range of over 12 but less than 20 is preferable for the etching factor. The range of 7 to 15 is by far more preferable for both of the production of blurred periphery and the etching factor.

Figure 8:
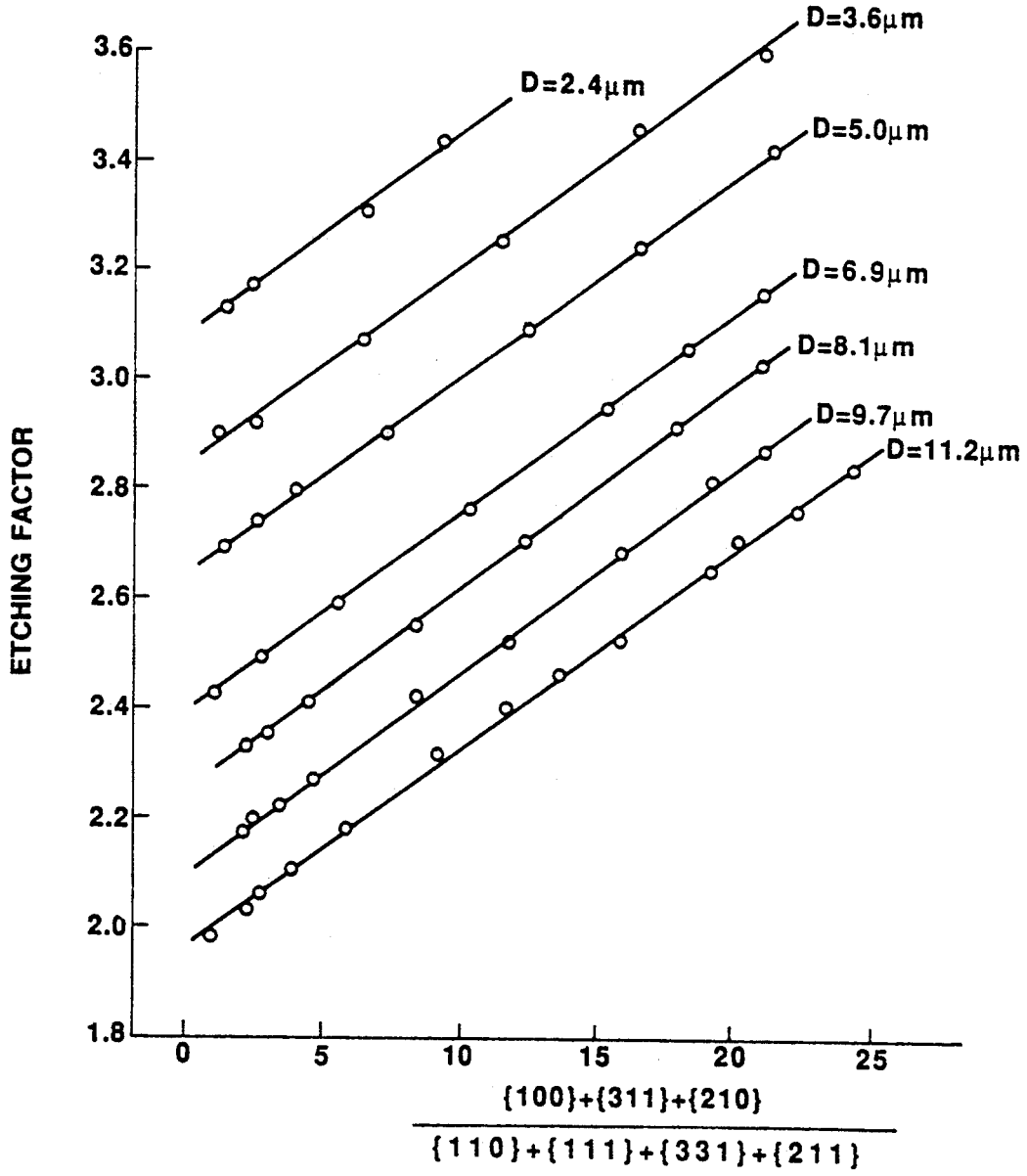
FIG. 8 shows the relation among etching factor, a ratio of the degree of plane, [{100}+{311}+{210}]/[{110}+{111}+{331}+{211}], and crystal grain size (D) in the thickness direction of the alloy sheet, being described in the preferred embodiment 2.

According to this invention, etching factor is improved by controlling the ratio of the degrees of specific planes on the surface of alloy sheet, as described above. More preferably, the crystal grain size in the thickness direction of the alloy sheet is selected at 10 μm or smaller to obtain higher etching factor. The grain size of 10 μm or smaller corresponds to the grain size number of No. 10.3 or higher level. FIG. 8 shows the relation among etching factor, ratio of the degrees of planes, [{100}+{311}+{210}]/[{110}+{111}+{331}+{211}], and crystal grain size (D) in the thickness direction of alloy sheet. The figure covers the range of 5% or less for the degree of {111} plane, 50 to 93% for {100} plane, 24% or less for {110} plane, 1 to 10% for {311} plane, 1 to 14% for {331} plane, 1 to 10% for {210} plane, and 1 to 10% for {211} plane. As seen in FIG. 8, even at the same ratio of the degrees of planes, the etching factor is increased by decreasing the crystal grain size in the thickness direction of alloy sheet at or below 10 μm.

Figure 9:
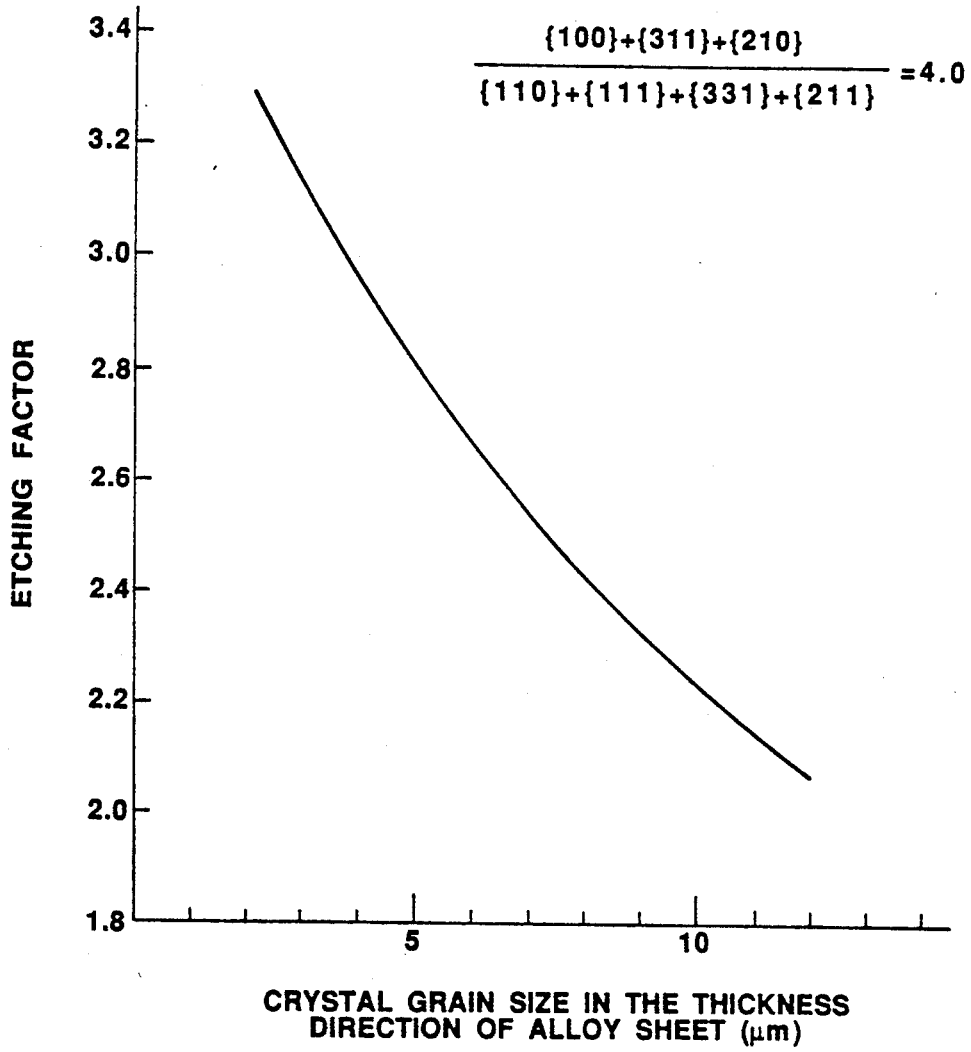
FIG. 9 shows the relation between etching factor and crystal grain size in the thickness direction of the alloy sheet, being described in the preferred embodiment 2.

FIG. 9 shows the relation between etching factor and crystal grain size in the thickness direction of alloy sheet under the specific condition of 4.0 (fixed) for the ratio of the degrees of planes, which is taken from FIG. 8. In case of the crystal grain size in the thickness direction being 10 μm, the etching factor is high. In case of the size being 1 to 5 μm, the etching factor is more preferable.

The alloy for a shadow mask of this invention specifies the degree of each plane and ratio of the degrees of planes on the surface of Fe-Ni or Fe-Mi-Co alloy sheet. For the case of Fe-Ni alloy, 34 to 38% of Ni content is preferred. In the case of Fe-Ni-Co alloy, 30 to 37% of i content and 0.01 to 6% of Co content are preferable. Other than those ingredients, 0.005% or less of C, 0.35% of less of Mn, 0.05% or less of Si, 0.05% or less of Cr, 0.0015% or less of N, and 0.0020% or less of O are the most preferable contents.

To keep the degree of each plane on the surface of the alloy sheet within the range specified in this invention, it is preferred to select adequate condition of thin alloy sheet making. All through the treatment from solidification, hot processing, cold rolling, to annealing, conditions which prevent the formation of these planes are selected as far as possible. For example, when the alloy is prepared from a hot-rolled steel strip which was obtained by blooming and hot-rolling the ingot or continuous casting slab, an adequate annealing after the hot-rolling is an effective means to control the degrees of planes {111}, {110}, {110}, {311}, {331}, {210}, and {211} planes. Temperature of annealing of hot-rolled sheet is preferably selected in a range of 910° to 990° C.

According to this invention, the annealed hot-rolled alloy sheet is subjected to cold-rolling, annealing, and finish cold-rolling responding to the degrees of individual planes. The reduction rate of cold-rolling, condition of annealing and finish cold-rolling are optimized. The annealing condition includes temperature, time, and heat-up rate. The effect of annealing of hot-rolled sheet appears when the hot-rolled alloy strip is sufficiently crystallized before annealing.

To acquire the satisfactory degrees of these seven planes being focused on in the present invention, the uniform heat treatment of the slab after slabbing is not preferable. For example, when a uniform heat treatment is carried at 1200° C. or higher temperature for 10 hours or longer period, at least one of the degrees of these seven planes exceeds the range specified in this invention. Therefore, such a uniform heat treatment must be avoided.

EXAMPLE

The alloy ingots having the composition listed in Table 1 were used. These ingots were subjected to slabbing, surface scarfing, and hot-rolling to provide hot-rolled steel strips. The heating condition in hot-rolling was 1100° C. for 3 hours. The hot-rolled steel strips were annealed in a temperature range of 910° to 990° C. After annealing, the hot-rolled steel strips were subjected to slabbing, cold-rolling, annealing, and finish cold-rolling. By varying the conditions of cold-rolling, annealing after the cold-rolling, and finish cold-rolling, the materials No. 101 through o. 121 were obtained. Each of these materials had specific degrees of planes and crystal grain size in the thickness direction of the alloy sheet, which are shown in Table 3 through Table 6. The hot-rolled steel strips are sufficiently crystallized after hot-rolling and the degree of each of planes, {111}, {100}, {110}, {331}, {311}, {210}, and {211} was determined by X-ray diffraction method described before.

On each of the obtained alloy sheet, a resist pattern was formed, and the etching factor was measured at 135 μm of $d_1$ shown in FIG. 5. Each of the alloy sheet was processed by photo-etching to form a flat mask, and the quantity of light penetrated therethrough was then measured. In the same manner, a conventional mild steel flat mask perforated to give the same opening with the alloy sheet was measured for its quantity of light penetrated therethrough. The penetration ratio of light of the alloy flat mask was determined from the quantity of light penetrated through the alloy sheet divided by the quantity of light penetrated through the mile steel sheet.

A non-contact laser roughness gauge was employed to determine the surface roughness on pierced hole of these flat masks. The cut-off value was 0.02 mm, and the roughness curve was derived by eliminating the tapered area on the hole interface as an waving component. The center line average roughness (Ra) was determined from the roughness curve. The production of blurred periphery of pierced hole of each flat mask was determined by visual observation.

As clearly shown in Table 3 through Table 6, the materials of No. 115 through No. 140 which have the degree of each of planes {111}, {100}, {110}, {331}, {311}, {210}, and {211}, and the ratio of the degrees of planes, [{100}+{311}+{210}]/[{110}+{111}+{331}+{211}], within the range specified in this invention provide the following advantages.

(a) The curve of flat mask after etching is at 2 mm or less, which level is lower than that in comparative example described later.

(b) The surface roughness (Ra) of the pierced holes is at 0.9 μm or less and 1.0 or higher light penetration of flat mask, which offers higher penetration than conventional mild steel flat mask.

(c) The etching factor is 2.0 or higher value, and the production of blurred periphery of pierced hole of flat mask is also at a level raising no problem in practical use.

Materials of No. 116, No. 117, No. 118, No. 131, No. 134, and No. 138 give the ratio of the degrees of planes, [{100}+{311}+{210}]/[{110}+{111}+{331}+{211}], as 2. Different from the material No. 118, the crystal grain size in the thickness direction of the alloy sheet for the materials of No. 116, No. 117, No. 181, No. 134, and No. 138 is 10 μm or less, which value is smaller than the level of conventional products, and the etching factor of these materials is higher than the conventional level, which indicates that these materials have superior etching performance. Among the materials of No. 116, No. 117, No. 131, No. 134, and No. 138, the one giving smaller crystal grain size in the thickness direction of the alloy sheet results in higher etching factor. The fact means that the reduction of crystal grain size in the thickness direction of alloy sheet is an effective factor to increase the etching factor.

Contrary to the preferred embodiment above described, the material No. 101 does not satisfy the range specified in this invention at its {111} plane, the material No. 102 does not satisfy at its {100} plane, the material No. 104 does not satisfy at its {110} plane, and the material No. 105 does not satisfy at its {311} plane. The materials of No. 101, No. 102, No. 104, and No. 105 give 7 mm or larger curve of flat mask after etching, which value is larger than the preferred embodiment of this invention.

The material No. 106 does not satisfy the range specified in this invention at its {331} plane, the material No. 107 does not satisfy at its {210} plane, and the material No. 108 does not satisfy at its {211} plane. The materials of No. 106 through No. 108 exceed 0.90 μm of surface roughness (Ra) on pierced hole, and give below 1.0 of penetration ratio of light of flat mask, the latter characteristic is lower than the preferred embodiment of this invention.

The material No. 103 does not satisfy the range specified in this invention at its {100} plane. The material No. 114 exceeds the upper limit of this invention at its ratio of the degrees of planes, [{100}+{311}+{210}]/[{110}+{111}+{331}+{211}]. The materials of No. 103 and No. 114 are inferior in the production of blurred periphery of pierced hole of flat mask to the preferred embodiment of this invention. The material No. 103 gives lower degree of {210} plane than the lower limit of this invention, and the material shows less than 2.00 of etching factor which is below the range being focused on in this invention.

The material No. 109 does not satisfy the range specified in this invention at its {211} plane, the material No. 110 does not satisfy at its {210} plane, the material No. 111 does not satisfy at its {331} plane, and the material No. 112 does not satisfy at its {311} plane. The material No. 113 gives the ratio of the degree of plane, [{100}+{311}+{210}]/[{110}+{111}+{331}+{211}], below the lower limit of this invention. The materials of No. 109 through No. 113 give less than 2.00 of etching factor which is below the range being focused on in the current invention.

TABLE 3

| Alloy symbol | Material No. | Degree of plane (%) {111} | {100} | {110} | {311} | {331} | {210} | {211} | Ratio of degrees of plane* | Crystal grain size (μm) |
|---|---|---|---|---|---|---|---|---|---|---|
| A | 101 | 6 | 50 | 9 | 6 | 13 | 8 | 8 | 1.78 | 11.0 |
| A | 102 | 1 | 38 | 23 | 10 | 9 | 10 | 9 | 1.38 | 11.5 |
| A | 103 | 1 | 94 | 2 | 1 | 1 | 0 | 1 | 19.00 | 13.4 |
| A | 104 | 1 | 50 | 30 | 8 | 2 | 5 | 4 | 1.70 | 11.1 |
| C | 105 | 1 | 52 | 20 | 11 | 6 | 5 | 5 | 2.13 | 11.2 |
| C | 106 | 2 | 57 | 5 | 4 | 15 | 10 | 7 | 2.45 | 13.2 |
| C | 107 | 4 | 50 | 7 | 5 | 14 | 12 | 8 | 2.03 | 11.1 |
| B | 108 | 3 | 51 | 7 | 5 | 14 | 9 | 11 | 1.86 | 11.1 |
| B | 109 | 0 | 92 | 4 | 1 | 2 | 1 | 0 | 15.67 | 11.5 |
| B | 110 | 1 | 91 | 0 | 1 | 6 | 0 | 1 | 11.50 | 12.2 |
| C | 111 | 0 | 73 | 12 | 10 | 0 | 2 | 3 | 5.67 | 13.2 |
| A | 112 | 1 | 91 | 0 | 0 | 6 | 1 | 1 | 11.50 | 11.0 |
| B | 113 | 1 | 52 | 23 | 4 | 9 | 2 | 9 | 0.72 | 11.2 |
| B | 114 | 1 | 93 | 1 | 1 | 1 | 2 | 1 | 24.0 | 11.2 |
| B | 115 | 2 | 63 | 9 | 4 | 12 | 5 | 5 | 2.57 | 11.2 |
| A | 116 | 2 | 58 | 16 | 6 | 7 | 6 | 5 | 2.23 | 9.7 |
| A | 117 | 1 | 56 | 22 | 7 | 5 | 5 | 4 | 2.13 | 3.6 |
| B | 118 | 1 | 52 | 24 | 9 | 4 | 6 | 4 | 2.03 | 11.2 |
| A | 119 | 3 | 61 | 13 | 6 | 8 | 6 | 3 | 2.70 | 8.1 |
| C | 120 | 2 | 65 | 12 | 6 | 8 | 5 | 2 | 3.17 | 9.7 |

Remarks *Ratio of degrees of planes is [{100} + {331} + {210}]/[{110} + {111} + {331} + {211}]

TABLE 4

| Alloy symbol | Material No. | Degree of plane (%) {111} | {100} | {110} | {311} | {331} | {210} | {211} | Ratio of degrees of plane* | Crystal grain size (μm) |
|---|---|---|---|---|---|---|---|---|---|---|
| C | 121 | 2 | 75 | 6 | 3 | 8 | 4 | 2 | 4.56 | 9.7 |
| B | 122 | 3 | 72 | 6 | 3 | 10 | 4 | 2 | 3.76 | 11.2 |
| A | 123 | 2 | 74 | 6 | 3 | 9 | 4 | 2 | 4.26 | 8.1 |
| B | 124 | 1 | 90 | 3 | 1 | 3 | 1 | 1 | 11.50 | 11.2 |
| C | 125 | 0 | 87 | 6 | 2 | 1 | 1 | 1 | 11.50 | 9.7 |
| B | 126 | 0 | 86 | 8 | 3 | 1 | 1 | 1 | 9.00 | 11.2 |
| A | 127 | 0 | 73 | 12 | 9 | 1 | 2 | 3 | 5.25 | 6.9 |
| C | 128 | 1 | 85 | 6 | 2 | 3 | 2 | 1 | 8.09 | 9.7 |
| A | 129 | 2 | 70 | 3 | 2 | 12 | 7 | 4 | 3.76 | 5.0 |
| B | 130 | 1 | 93 | 2 | 1 | 1 | 1 | 1 | 19.00 | 11.2 |
| A | 131 | 5 | 58 | 5 | 3 | 14 | 8 | 7 | 2.23 | 5.0 |
| B | 132 | 0 | 91 | 4 | 1 | 2 | 1 | 1 | 13.29 | 11.2 |
| B | 133 | 1 | 80 | 9 | 3 | 3 | 2 | 2 | 5.67 | 11.2 |
| C | 134 | 1 | 51 | 24 | 10 | 4 | 5 | 5 | 1.94 | 2.4 |
| A | 135 | 0 | 59 | 21 | 9 | 3 | 4 | 4 | 2.57 | 6.9 |
| A | 136 | 0 | 83 | 9 | 5 | 1 | 1 | 1 | 8.10 | 8.1 |
| C | 137 | 2 | 53 | 23 | 9 | 4 | 4 | 5 | 1.94 | 9.7 |
| A | 138 | 0 | 50 | 24 | 13 | 4 | 5 | 4 | 2.13 | 8.1 |
| B | 139 | 1 | 88 | 2 | 2 | 3 | 3 | 1 | 15.60 | 11.2 |
| C | 140 | 1 | 90 | 2 | 3 | 1 | 2 | 1 | 19.0 | 9.7 |

Remarks *Ratio of degrees of planes is [{100} + {331} + {210}]/[{110} + {111} + {331} + {211}]

TABLE 5

| Alloy symbol | Material No. | Curve of flat mask (mm) | Surface roughness (Ra, μm) | Penetration ratio of light | Production of blurred periphery of pierced hole | Etching factor |
|---|---|---|---|---|---|---|
| A | 101 | 10 | 0.90 | 1.00 | B | 2.02 |
| A | 102 | 7 | 0.77 | 1.05 | B | 2.00 |
| A | 103 | 3 | 0.86 | 1.01 | E | 1.93 |
| A | 104 | 15 | 0.60 | 1.10 | B | 2.03 |
| C | 105 | 12 | 0.64 | 1.08 | B | 2.01 |
| C | 106 | 3 | 0.95 | 0.98 | B | 2.02 |
| C | 107 | 3 | 1.11 | 0.92 | B | 2.02 |
| B | 108 | 3 | 1.27 | 0.88 | B | 2.03 |
| B | 109 | 4 | 0.86 | 1.02 | B | 1.97 |
| B | 110 | 3 | 0.88 | 1.01 | B | 1.95 |
| C | 111 | 2 | 0.84 | 1.02 | B | 1.97 |
| A | 112 | 3 | 0.80 | 1.03 | B | 1.96 |

TABLE 5-continued

| Alloy symbol | Material No. | Curve of flat mask (mm) | Surface roughness (Ra, μm) | Penetration ratio of light | Production of blurred periphery of pierced hole | Etching factor |
|---|---|---|---|---|---|---|
| B | 113 | 3 | 0.79 | 1.03 | B | 1.99 |
| B | 114 | 3 | 0.89 | 1.01 | E | 2.84 |
| B | 115 | 2 | 0.83 | 1.03 | A | 2.06 |
| A | 116 | 2 | 0.73 | 1.05 | A | 2.19 |
| A | 117 | 1 | 0.70 | 1.07 | A | 2.92 |
| B | 118 | 1 | 0.71 | 1.06 | A | 2.04 |
| A | 119 | 2 | 0.72 | 1.05 | A | 2.35 |
| C | 120 | 2 | 0.69 | 1.07 | A | 2.22 |

TABLE 6

| Alloy symbol | Material No. | Curve of flat mask (mm) | Surface roughness (Ra, μm) | Penetration ratio of light | Production of blurred periphery of pierced hole | Etching factor |
|---|---|---|---|---|---|---|
| C | 121 | 1 | 0.65 | 1.08 | A | 2.27 |
| B | 122 | 1 | 0.72 | 1.06 | A | 2.11 |
| A | 123 | 1 | 0.70 | 1.07 | A | 2.41 |
| B | 124 | 2 | 0.43 | 1.15 | A | 2.40 |
| C | 125 | 2 | 0.24 | 1.20 | A | 2.52 |
| B | 126 | 2 | 0.31 | 1.20 | A | 2.31 |
| A | 127 | 1 | 0.49 | 1.13 | A | 2.59 |
| C | 128 | 2 | 0.50 | 1.13 | A | 2.41 |
| A | 129 | 1 | 0.84 | 1.02 | A | 2.79 |
| B | 130 | 2 | 0.80 | 1.04 | A | 2.65 |
| A | 131 | 2 | 0.85 | 1.02 | A | 2.74 |
| B | 132 | 2 | 0.54 | 1.11 | A | 2.46 |
| B | 133 | 1 | 0.52 | 1.12 | A | 2.18 |
| C | 134 | 1 | 0.68 | 1.08 | A | 3.17 |
| A | 135 | 1 | 0.65 | 1.08 | A | 2.49 |
| A | 136 | 1 | 0.35 | 1.17 | A | 2.55 |
| C | 137 | 1 | 0.67 | 1.07 | A | 2.17 |
| A | 138 | 2 | 0.69 | 1.08 | A | 2.33 |
| B | 139 | 1 | 0.53 | 1.13 | B | 2.53 |
| C | 140 | 1 | 0.55 | 1.12 | C | 2.81 |

What is claimed is:

1. Thin metallic sheet for shadow mask comprising:

a Fe-Ni alloy sheet having Fe and Ni as major elements;

said alloy sheet having degrees of planes on a surface, the degree of {331} plane being 14% or less, the degree of {210} plane being 10% or less and the degree of {211} plane being 10% or less, each of said degrees of planes being calculated by means of dividing a relative X-ray intensity ratio of each of (331), (210) and (211) diffraction planes by a sum of relative X-ray intensity ratios of (111), (200), (220), (311), (331), (420) and (422) diffraction planes; and a ratio of degrees of planes, which is {210}/[{331}+{211}] being 0.2 to 1.

2. The thin metallic sheet of claim 1, wherein said alloy sheet has a crystal grain size of 10 μm or less in a thickness direction of said alloy sheet.

3. The thin metallic sheet of claim 2, wherein said crystal grain size is 1 to 5 μm.

4. The thin metallic sheet of claim 1, wherein said ratio of the degrees of planes is 0.2 to 0.6.

5. The thin metallic sheet of claim 4, wherein said ratio of the degrees of planes is over 0.6 but equal to 1 or less.

6. The thin metallic sheet of claim 1, wherein said alloy sheet consists essentially of Ni of 34 to 38 wt. %, C of 0.005 wt. % or less, Mn of 0.35 wt. % or less, Si of 0.05 wt. % or less, Cr of 0.05 wt. % or less, N of 0.0015 wt. % or less and O of 0.002 wt. % or less, the balance being Fe.

7. The thin metallic sheet of claim 1, wherein said alloy sheet consists essentially of Ni of 30 to 37 wt. %, Co of 0.01 to 6 wt. %, C of 0.005 wt. % or less, Mn of 0.35 wt. % or less, Si of 0.05 wt. % or less, Cr of 0.05 wt. % or less, N of 0.0015 wt. % or less and O of 0.002 wt. % or less, the balance being Fe.

8. Thin metallic sheet for shadow mask comprising:

a Fe-Ni alloy sheet having Fe and Ni as major elements;

degrees of planes on a surface of said alloy sheet, the degree of {111} plane being 5% or less, the degree of {100} plane being 50 to 93%, the degree of {110} being 24% or less, the degree of {311} plane being 1 to 10%, the degree of {331} plane being 1 to 14%, the degree of {210} plane being 1 to 10%, the degree of {211} plane being 1 to 10%, each of said degrees of planes being calculated by means of dividing a relative X-ray intensity ratio of each of (111), (100), (110), (311), (331), (210) and (211) diffraction planes by a sum of relative X-ray intensity ratios of said diffraction planes; and a ratio of degrees of planes which is [{100}+{311}+{210}]/[{110}+{111}+{331}+{211}] being 0.8 to 20.

9. The thin metallic sheet of claim 8, wherein said alloy sheet has a crystal grain size of 10 μm or less in a thickness direction of said alloy sheet.

10. The thin metallic sheet of claim 9, wherein said crystal grain size is 1 to 5 μm.

11. The thin metallic sheet of claim 8, wherein said ratio of the degrees of planes is 0.8 to 12.

12. The thin metallic sheet of claim 11, wherein said ratio of the degrees of planes is over 12 but equal to 20 or less.

13. The thin metallic sheet of claim 8, wherein said alloy sheet consists essentially of Ni of 34 to 38 wt. %, C of 0.005 wt. % or less, Mn of 0.35 wt. % or less, Si of 0.05 wt. % or less, Cr of 0.05 wt. % or less, N of 0.0015 wt. % or less and O of 0.002 wt. % or less, the balance being Fe.

14. The thin metallic sheet of claim 8, wherein said alloy sheet consists essentially of Ni of 30 to 37 wt. %, Co of 0.01 to 6 wt. %, C of 0.005 wt. % or less, Mn of 0.35% or less, Si of 0.05 wt. % or less, Cr of 0.05 wt. % or less, N of 0.0015 wt. % or less and O of 0.002 wt. % or less, 4he balance being Fe.

15. An improved shadow mask wherein the improvement comprises making the mask from a thin metallic sheet comprising:

a Fe-Ni alloy sheet having Fe and Ni as major elements;

said alloy sheet having degrees of planes on a surface, the degree of {331} plane being 14% or less, the degree of {210} plane being 10% or less and the degree of {211} plane being 10% or less, each of said degrees of planes being calculated by means of dividing a relative X-ray intensity ratio of each of (331), (210) and (211) diffraction planes by a sum of relative X-ray intensity ratios of (111), (200), (220), (311), (331), (420) and (422) diffraction planes; and a ratio of degrees of planes, which is {210}/[{331}+{211}] being 0.2 to 1.

16. The shadow mask of claim 15, wherein said alloy sheet has a crystal grain of 10 μm or less in a thickness direction of said alloy sheet.

* * * * *